US007370490B2

(12) United States Patent
Li

(10) Patent No.: US 7,370,490 B2
(45) **Date of Patent: *May 13, 2008**

(54) AIR-CONDITIONING SYSTEM WITH FULL HEAT RECOVERY

(76) Inventor: Zhiming Li, No. 1 Industry Zone, Taihe Town, Baiyun District, Guangzhou (CN) 510540

( * ) Notice: Subject to any disclaimer, the term of this patent is extended or adjusted under 35 U.S.C. 154(b) by 275 days.

This patent is subject to a terminal disclaimer.

(21) Appl. No.: 11/169,651

(22) Filed: Jun. 30, 2005

(65) Prior Publication Data

US 2007/0000274 A1 Jan. 4, 2007

(51) Int. Cl.
*F28D 5/00* (2006.01)

(52) U.S. Cl. ..... 62/305; 62/310

(58) Field of Classification Search ..... 62/179, 62/180, 185, 201, 305, 310, 309, 314, 121, 62/315, 333; 261/151, 153, 155
See application file for complete search history.

(56) References Cited

U.S. PATENT DOCUMENTS 4,023,949 A * 5/1977 Schlom et al. ..... 62/309
4,156,351 A * 5/1979 Schlom et al. ..... 62/121
4,259,268 A * 3/1981 DiRoss ..... 261/151
4,308,222 A * 12/1981 Goettel et al. ..... 261/117
4,361,525 A * 11/1982 Leyland ..... 261/152
4,478,767 A * 10/1984 Watanabe et al. ..... 261/130
4,612,778 A * 9/1986 Medrano ..... 62/311
4,926,656 A * 5/1990 Hickley et al. ..... 62/310
5,263,337 A * 11/1993 McMillan et al. ..... 62/304
5,606,868 A * 3/1997 Calvert ..... 62/315
5,737,937 A * 4/1998 Akazawa ..... 62/303
6,276,152 B1 * 8/2001 Sibik ..... 62/201

FOREIGN PATENT DOCUMENTS

EP 0477475 A2 * 4/1992

* cited by examiner

*Primary Examiner*—Mohammad M. Ali

(57) ABSTRACT

The present invention relates to an air-conditioning system with full heat recovery comprising a condenser, an evaporator, a compressor and an expansion valve; one side of the condenser is disposed in a position corresponding to an indoor air outlet and an outdoor air inlet; the other side of the condenser is provided with an exhaust vent; and a cooling fan is disposed between the exhaust vent and a cooling air opening. The present air-conditioning system with full heat recovery can be connected with a condensate recycle system. The present invention utilizes low temperature, low humidity indoor exhaust air as cooling air for the evaporative condenser. It makes use of the sensible heat (temperature difference) of indoor exhaust air as well as the latent heat (humidity difference) of indoor exhaust air, thereby attaining better condensation effects. It also uses the condensate to assist cooling and increases cooling and water saving effects. The present invention can be widely used in the air-conditioning systems in restaurants, hospitals, supermarkets, villas and offices and has wide applications.

10 Claims, 9 Drawing Sheets

D-D

AIR-CONDITIONING SYSTEM WITH FULL HEAT RECOVERY

BACKGROUND OF THE INVENTION

The present invention relates to air-conditioning cooling apparatus and more particularly pertains to an air-conditioning system with full heat recovery.

Following the increasing popularity of air-conditioners, the air-conditioning industry has been fast developing in the past decade. However, the increasing popularity of air-conditioners exerts enormous pressure on the existing insufficient electricity supply facilities. Statistics show that electricity consumption-of-air-conditioners amounts to 35% of the total electricity consumption of an office building. The operational costs of air-conditioners are huge. Developing air-conditioning facilities of effective energy saving capability has therefore been a development trend in the air-conditioning industry.

The existing air-conditioners are mainly divided into two types, namely air-cooled air-conditioners and water-cooled air-conditioners. Air-cooled air-conditioners utilize outdoor air directly as the cooling agent to cool the apparatus. Since the refrigeration operation of air-conditioners is mainly in the seasons of higher temperature, the refrigeration efficiency of directly using outdoor air for cooling is therefore relatively low, where the COP (coefficient of performance) is maintained at around 2.0. It can be seen that this type of air-conditioners is of high energy consumption. However, air-cooled air-conditioners dominate the market because of the convenience in installation and the flexibility in location. Water-cooled air-conditioners utilize water as the cooling agent and bring the exhaust heat of the refrigeration system to the cooling tower. Heat is then discharged outdoor by the cooling tower. Since the cooling tower can lower the temperature of cooling water to approximately the outdoor wet-bulb temperature, the refrigeration system operates with cooling water of outdoor wet-bulb temperature, thereby increasing the refrigeration efficiency of the water-cooled air-conditioners, where the COP can reach 3.8 to 4.0. Nevertheless, since water-cooled air-conditioners are installed additionally with a cooling tower and a cooling pump, the overall energy consumption of the system and the costs of the apparatus increase. Moreover, for the purposes of heat radiation, traditional cooling towers usually use water sprinklers to spray water evenly. Water drops from this type of sprayers are relatively small. Further, there are relatively strong winds in the cooling tower. Therefore, it is common for water drops to "fly" out of the cooling tower during its operation as small water drops are carried by strong winds to spill out from the tower directly. This water spillage amounts to over 50% of the total water consumption of the cooling tower, while the water used for actual evaporation and heat radiation is less than 50%. Furthermore, the air-conditioners produce large volume of condensate during the refrigeration process. Known skills are to directly discharge the condensate that is produced. Since the temperature of condensate is as low as 10° C. to 15° C., the cooling energy loss is relatively high. If the condensate can be directly recycled to assist cooling, the temperature of cooling water can be lowered and energy can be saved, and this can greatly reduce the consumption of cooling water.

In addition, when the air-conditioner is used, for the purposes of satisfying the hygienic requirements of indoor air, fresh air has to be supplied continuously to the air-conditioning area. In existing air-conditioning systems, fresh air load amounts to around 30% of the total air-conditioning load and the energy consumption is high. To reduce the total load, fresh air reduction methods are often used, which lead to poorer air quality in the air-conditioning area and fail to satisfy the hygienic requirements. Further, an exhaust system that discharges some of the indoor air to the outside has to be installed to facilitate indoor air exchange. The discharged air is a cooling air source of low temperature and humidity. Its temperature is usually relatively low at 25° C. to 28° C. Its relative humidity is also low at 60% to 70% and its wet-bulb temperature is even as low as 20° C. to 23° C. The existing air-conditioners of air-conditioning systems fail to utilize this cooling energy and thus lead to wastage directly.

BRIEF SUMMARY OF THE INVENTION

In view of the aforesaid disadvantages now present in the prior art, the object of the present invention is to provide an air-conditioning system with full heat recovery which is highly effective, energy saving, water saving and healthy.

To attain this, the present invention generally comprises a condenser, an evaporator, a compressor and an expansion valve, wherein one side of the condenser is disposed in a position corresponding to an indoor air outlet and an outdoor air inlet; the other side of the condenser is provided with an exhaust vent; and a cooling fan is disposed between the exhaust vent and a cooling air opening.

The outdoor air inlet is installed with an airflow regulation valve to regulate the mixing ratio of outdoor air and indoor air, and the range of regulation ratio is 0% to 100% (i.e. the mixing ratio of outdoor air to indoor air is 0:1 to 1:1).

The condenser can be installed outdoor, where one side of the condenser is provided with a cooling air opening; the cooling air opening connects with an air pipe and the air pipe connects simultaneously with an indoor air outlet and an outdoor air inlet through subsidiary pipes; the indoor air outlet is disposed on the wall separating the indoor and outdoor environments and the outdoor air inlet connects to the outdoor atmosphere directly.

As an alternative, the condenser can be installed indoor, where the space on one side of the condenser is provided with an indoor air outlet and an outdoor air inlet; the indoor air outlet connects to the indoor environment and the outdoor air inlet connects to the outdoor environment through an air pipe; the space on the other side of the condenser is provided with an exhaust vent and the exhaust vent connects to the outdoor environment directly or through an air pipe.

The condenser is an evaporative condenser comprising a water sprayer, a heat exchange plate or heat exchange tube, a water tank and a recycling water pump; the water sprayer is disposed above the heat exchange plate or heat exchange tube; the water tank is disposed below the heat exchange plate or heat exchange tube; the recycling water pump connects with the water sprayer and the water tank.

A filling can be disposed between the heat exchange plate and the water tank, for example a PVC filling. The provision of a filling ensures that cooling water flowing through can be-maintained at a certain temperature for a longer time.

The heat exchange plate comprises a plate body and the plate body is provided with channels.

The plate body can be provided with a flat surface on one side and with ridges protruding on the other side forming empty channels, or it can also be provided with ridges on both sides to form the empty channels.

The outer surface of the plate body can be a slick surface. It can also be a fortified heat conducting surface with enhanced heat exchange effects. For example, it can be provided with one or a plurality of outer wing panel.

The shape of the channels can be of a continuous "S" shape.

The cross sectional shape of the channels can be circular, elliptical, olive-shaped, square-shaped, trapezoidal or other irregular shapes; the actual shape depends on the specific production needs of the heat exchange apparatus.

The entrance and exit of the channels can be flexibly disposed depending on the actual usage requirement. For example, it can be disposed in a corner position of the plate body or on the sides of the plate body.

The connection between the entrance or exit of the channels and an exterior junction can be performed by welding or flanged connection.

There can be one or more-heat exchange plates. The actual number can be flexibly adjusted depending on the refrigeration volume required. When more than one heat exchange plates are used, the heat exchange plates are arranged in parallel.

The water sprayer can be a slot-type water sprayer or a perforated water sprayer.

Slot-typed water spray troughs are disposed at the bottom of the slot-type water sprayer. The exit at the bottom end of the slot-typed water spray troughs can be provided with one or a plurality of guiding plate.

As an alternative, water spray holes are disposed at the bottom of the perforated water sprayer. Guiding nozzles are disposed inside the water spray holes. The guiding nozzles are disposed in a position corresponding to the tube body which is connected with the upper end of the heat exchange plate. Owing to the guiding nozzles, water flows to the top of the tube body and along the surface of the tube body evenly to the surface of the heat exchange plate.

The cross section of the tube can be circular, elliptical, droplet-shaped, rhombus-shaped, square-shaped or of other shapes.

The present air-conditioning system with full heat recovery can be connected with a condensate recycle system and the condensate recycle system connects with the water sprayer or the water tank of the evaporative condenser. The condensate recycle system can recycle cooling energy of the condensate-to assist the cooling of the evaporative condenser.

The condensate recycle system comprises a water receptacle and a condensate pipe; the water receptacle is disposed below an evaporator; one end of the condensate pipe connects with the water receptacle and the other end thereof connects with the water sprayer or the water tank. The condensate recycle system can be provided with a water pump on the condensate pipe depending on the actual needs. It provides power to transfer the condensate to the water sprayer or the water tank.

A filter can be disposed at the exit of the condensate pipe.

For an integrated unit of air-conditioner, the evaporator is disposed in a position simultaneously corresponding to an outdoor fresh air opening and an indoor return air opening; the outdoor fresh air opening connects to the outdoor environment by directly disposing on the wall or through an air pipe; the indoor return air opening connects to the indoor environment; the outdoor fresh air opening and the indoor return air opening are adjustable air openings, where the degree of opening of the air openings is regulated by airflow regulation-valves which are provided in the air openings, thereby controlling air flow.

For a one-plus-multiple split-type air-conditioner, the evaporator can be a direct evaporation fan coil unit which is installed indoor.

The evaporator of the present air-conditioning system with full heat recovery is a finned evaporator.

The present air-conditioning system with full heat recovery can be an integrated unit (packaged unit) or can be separated into two or more components (split-type unit) depending on needs, that is, the system can be a one-plus-one split-type system or a one-plus-multiple poly system. Various components form an integrated system through connecting pipes.

The present air-conditioning system with full heat recovery can be provided with a humidifier if required. Humidity control requirements are guaranteed by humidifying air. A heater can also be provided if required. The heater is disposed on one side of the evaporator to assist heating and changing air temperature and humidity, thereby effecting an air processing mode with constant temperature and humidity.

The inner walls of the casing of the present air-conditioning system with full heat recovery can be disposed with soundproof material to insulate against noise from internal components such as the fan and the compressor during operation, so as to reduce the impacts on the surroundings.

The present air-conditioning system with full heat recovery operates as follows: the condenser, expansion valve, evaporator and compressor of the present air-conditioning system with full heat recovery are sequentially connected to form a closed refrigeration circuit. The refrigeration circuit utilizes a coolant (e.g. chlorofluorocarbon) for refrigeration to cool indoor air. During the same time, the cooling fan introduces indoor exhaust air (of lower temperature and relative humidity) and outdoor air from the indoor air outlet and the outdoor air inlet into the space in which the evaporative condenser is located in order to perform heat exchange with the evaporative condenser and with the cooling water that flows through the evaporative condenser. The cooling water transfers heat to the cooling air by transferring heat (sensible heat) to the cooling air and by evaporating water (latent heat) of the cooling air. The temperature of the cooling water decreases and the temperature of the cooling air (indoor exhaust air and outdoor air) increases. Finally, it is discharged from the machine from the exhaust vent through the cooling fan. This efficiently utilizes the cooling energy of air and attains the object of energy saving. In addition, the condensate recycle system can at the same time recycle the condensate of lower temperature and mix it with the condensate in the evaporative condenser, thereby reducing the overall temperature of the condensate. This serves to assist the cooling of the evaporative condenser and effectively uses the cooling energy and saves water.

The present invention utilizes low temperature, low humidity indoor exhaust air as cooling air for the evaporative condenser. It makes use of the sensible heat (temperature difference) of indoor exhaust air as well as the latent heat (humidity difference) of indoor exhaust air. The condensation effect is much better than directly utilizing outdoor air as cooling air. It prevents energy loss due to air exchange and ventilation and attains prominent energy saving effects when compared with the existing cooling systems. Annual operational costs can be reduced by more than 30%.

The present invention does not require a condensate discharge system. The present invention directly recycles condensate which is discharged in the existing facilities into the cooling water system as cooling water. Since the temperature of the condensate is low, the cooling energy of the condensate is recycled and better-cooling effects can be attained. Direct recycle of the condensate also prominently saves cooling water consumption of the cooling systems. When compared with cooling systems using cooling towers, the present invention has a very high water-saving efficiency.

Since indoor exhaust full heat recovery is achieved, the fresh air load of the air-conditioning system is greatly reduced. Volume of fresh air is increased while the cooling load of the system is not significantly increased, thereby effectively improving indoor air quality and making the present invention energy and water saving and healthy in application.

The present invention does not require a cooling tower or a powerful cooling water pump, thereby lowering engineering costs and energy consumption. When compared with the cooling water systems of existing cooling systems, the present invention can save more than 15% of energy in this regard. Since no cooling tower is required, the water-film spraying of the condenser of the present invention completely eliminates water spillage. Therefore, when compared with other cooling systems using cooling towers, the present invention can attain water saving effects of over 50%.

The present invention recycles energy to the largest extent and lowers energy and water consumption. It effectively solves the problems of increased energy consumption due to an increase in fresh air volume of air-conditioning systems. It possesses the features of energy and water saving and healthy application. It can be widely used in the air-conditioning systems in restaurants, hospitals, supermarkets, villas, offices and so forth. It has wide applications and good market prospects.

DETAILED DESCRIPTION OF THE INVENTION

The present invention is further described by the following embodiments with the accompanying drawings, but the embodiments should not be regarded as limiting.

Figure 1:
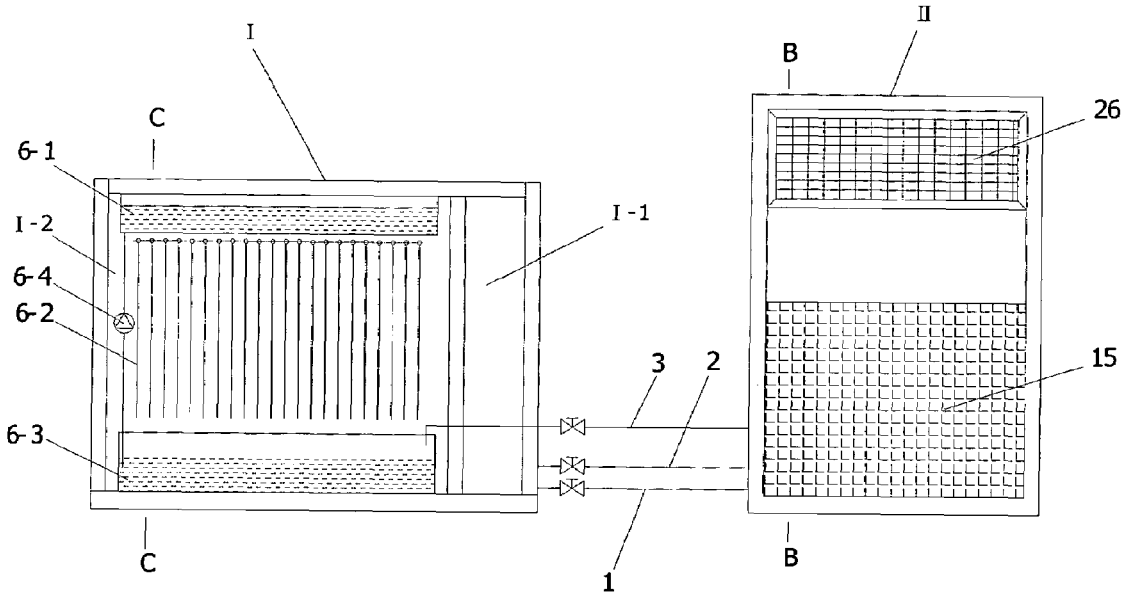
FIG. 1 shows a structural diagram of the air-conditioning system with full heat recovery of the present invention.
Figure 2:
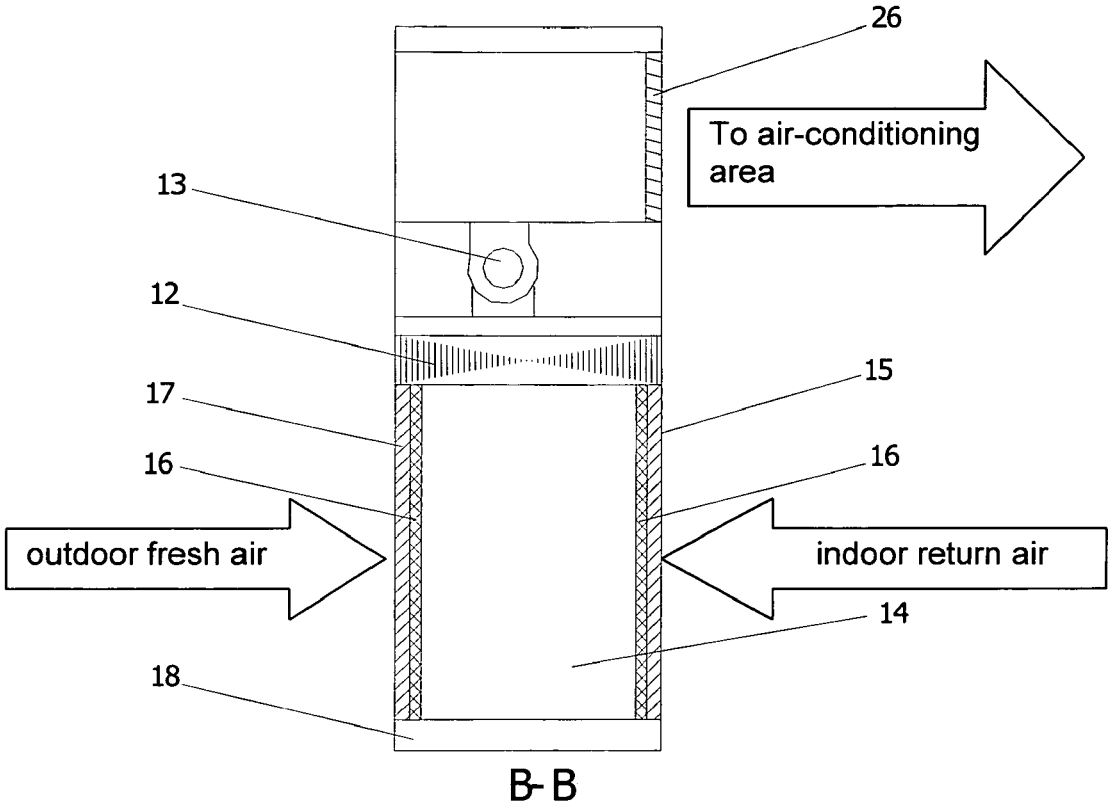
FIG. 2 shows the cross sectional view along line B-B of an indoor unit of the air-conditioning system with full heat recovery as in FIG. 1.
Figure 3:
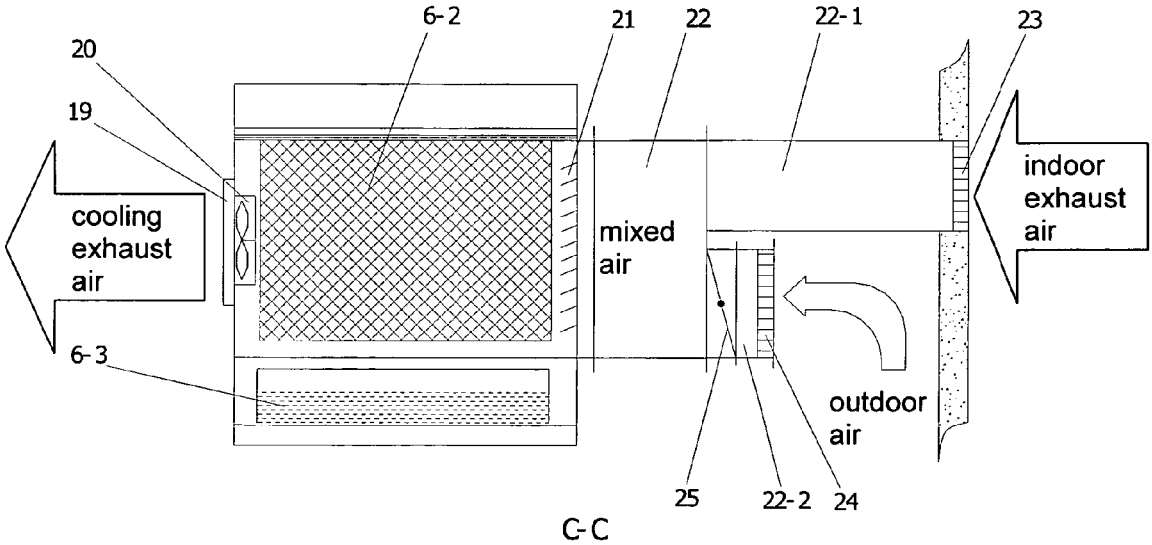
FIG. 3 shows the cross sectional view along line C-C of an outdoor unit of the air-conditioning system with full heat recovery as in FIG. 1.
Figure 4:
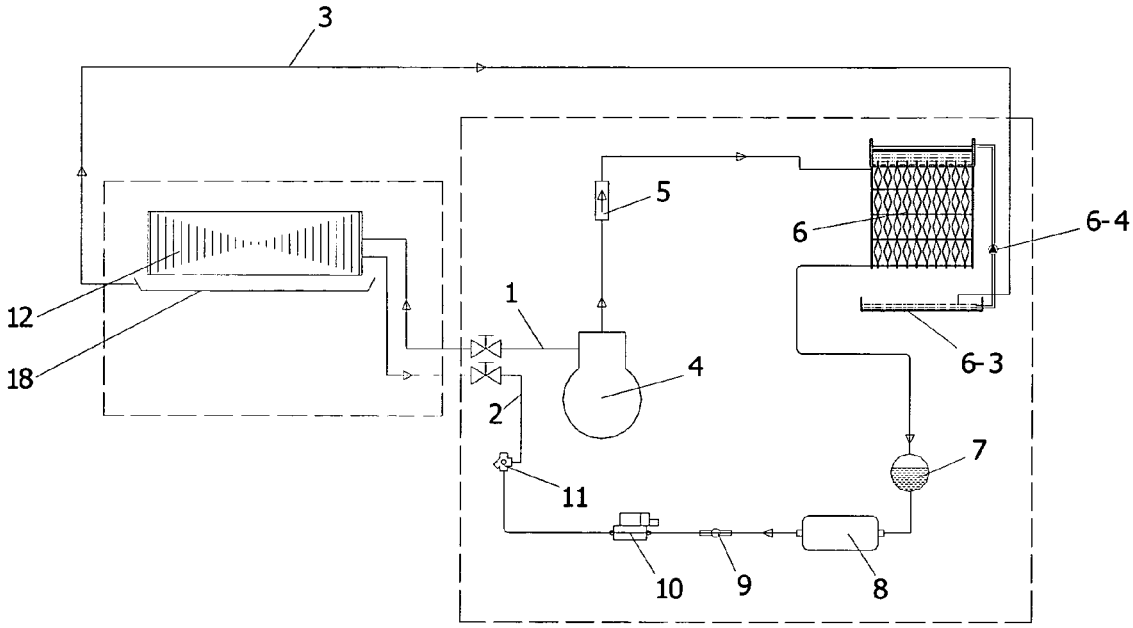
FIG. 4 shows the schematic diagram of the refrigeration process of the air-conditioning system with full heat recovery as in FIG. 1.

FIGS. 1 to 4 show the structure of the present invention. The present air-conditioning system with full heat recovery is of a split-type structure with a main unit (outdoor unit) I which cools a terminal (indoor unit) II. As illustrated in FIG. 1, the main unit I and the terminal II are connected through a liquid supply pipe 1, a return air pipe 2 and a condensate recycling pipe 3. FIG. 4 shows the operation of this embodiment. A compressor 4, a one-way valve 5, an evaporative condenser 6, a liquid storage member 7, a drier-filter 8, a liquid mirror 9, a liquid supply electromagnetic valve 10, an expansion valve 11 and a finned evaporator 12 are sequentially connected to form a closed refrigeration circuit, and a coolant (chlorofluorocarbon) flows in the refrigeration circuit to perform refrigeration, wherein the finned evaporator 12 is disposed in the indoor unit and other components are disposed in the outdoor unit. FIG. 2 shows the structure of the indoor unit 11. As illustrated in FIG. 2, the finned evaporator 12 and the air fan 13 are disposed in the casing of the indoor unit; one side of the casing of the indoor unit is provided with an indoor air vent 26; a return air box 14 is disposed below the finned evaporator 12; the front of the return air box 14 is an indoor return air opening 15 and a filter 16 is disposed behind the indoor return air opening 15; the back of the return air box 14 is provided with a fresh air opening 17 and a filter 16 is disposed behind the fresh air opening 17; the indoor return air opening 15 and the fresh air opening 17 are provided with airflow regulation valves to regulate the degree of opening of the air openings. FIGS. 1 and 3 show the structure of the outdoor unit 1. As illustrated in FIG. 1, the outdoor unit I comprises two parts I-1, I-2; the part I-1 is a compressor casing comprising refrigeration components such as the compressor 4, the one-way valve 5, the liquid storage member 7, the drier-filter 8 and the expansion valve 11; the part I-2 is disposed with the evaporative condenser 6; the evaporative condenser 6 comprises a water sprayer 6-1, a heat exchange plate 6-2, a water tank 6-3 and a recycling water pump 64; the water sprayer 6-1 is disposed above the heat exchange plate 6-2; the water tank 6-3 is disposed below the heat exchange plate 6-2; the recycling water pump 64 connects with the water sprayer 6-1 and the water tank 6-3 to form a cooling water circulation system. Further, as illustrated in FIG. 2, a water receptacle 18 is disposed below the finned evaporator 12, and the water receptacle 18 also connects with the water tank 6-3 through the condensate recycling pipe 3. As illustrated in FIG. 3, an exhaust vent 19 is disposed on one side of the heat exchange plate 6-2; a cooling fan 20 is disposed between the heat exchange plate 6-2 and the exhaust vent 19; a cooling air opening 21 is disposed on the other side of the heat exchange plate 6-2; the cooling air opening 21 connects with an air pipe 22; the air pipe 22 connects through subsidiary pipes 22-1, 22-2 with an indoor air outlet 23 and an outdoor air inlet 24; the outdoor air inlet 24 is installed with an airflow regulation valve 25 to regulate the mixing ratio of outdoor air and indoor air, and the range of regulation ratio is 0% to 100% (i.e. the mixing ratio of outdoor air to indoor air is 0:1 to 1:1).

The present air-conditioning system with full heat recovery operates as follows: when the coolant is compressed by the compressor 4 into a high temperature, high pressure gas, it-is led by pipes to the heat exchange plate 6-2 of the evaporative condenser 6. When it flows through the heat exchange plate 6-2, the high temperature, high pressure gas is cooled and condensed into a low temperature, high pressure liquid and is led to the liquid storage member 7 for storage. When the liquid supply electromagnetic valve 10 is turned on, the coolant liquid flows out from the liquid storage member 7 and flows through the drier-filter 8, the liquid mirror 9, the liquid supply electromagnetic valve 10 and the expansion valve 11 to form a low temperature, high pressure gas which enters the finned evaporator 12 and performs heat exchange with the indoor and the outdoor mixed air that flows through the finned evaporator 12, thereby cooling the mixed air. After cooling, the mixed air is led indoor through the indoor air vent 26. The coolant in the form of a low temperature, low pressure gas then flows from the finned evaporator 12 to the compressor 4, which then completes the refrigeration cycle. When the coolant flows through the heat exchange plate 6-2, the recycling water pump 6-4 is activated to pump water out from the water tank 6-3 to the water sprayer 6-1. Water flows from the slot-typed water spray troughs of the water sprayer 6-1 and on the surface of the two sides of the heat exchange plate 6-2 in the form of water film, where it performs heat exchange with the coolant that flows inside the heat exchange plate 6-2. After heat exchange, the water flows back to the water tank 6-3.

Regulation of the mixing ratio of indoor return air and outdoor fresh air in the above operation can be effected by regulating the degree of opening of the airflow regulation valves of the indoor return air opening 15 and the fresh air opening 17. This fulfills indoor air quality requirements and effects energy and water saving by mixing air output. Moreover, the cooling fan 20 of the outdoor unit introduces indoor exhaust air (of lower temperature and relative humidity) and outdoor air from the indoor air outlet 23 and the outdoor air-inlet 24 into the evaporative condenser 6 in order to perform heat exchange with the heat exchange plate 6-2 and with the cooling water that flows through the heat exchange plate 6-2. The cooling water transfers heat to the cooling air by transferring heat (sensible heat) to the cooling air and by evaporating water (latent heat) of the cooling air. The temperature of the cooling water decreases and the temperature of the cooling air (indoor exhaust air and outdoor air) increases. Finally, it is discharged from the machine from the exhaust vent 19 through the cooling fan 20. This efficiently utilizes the cooling energy of air and attains the object of energy saving. In addition, the finned evaporator 12 produces a large amount of condensate of relatively low temperature during the process. After the condensate is collected by the water receptacle 18, it flows to the water tank 6-3 through the condensate recycling pipe 3 and mixes with the condensate in the evaporative condenser 6, thereby reducing the overall temperature of the condensate. This serves to assist the cooling of the evaporative condenser 6 and effectively uses the cooling energy and saves water.

Figure 5:
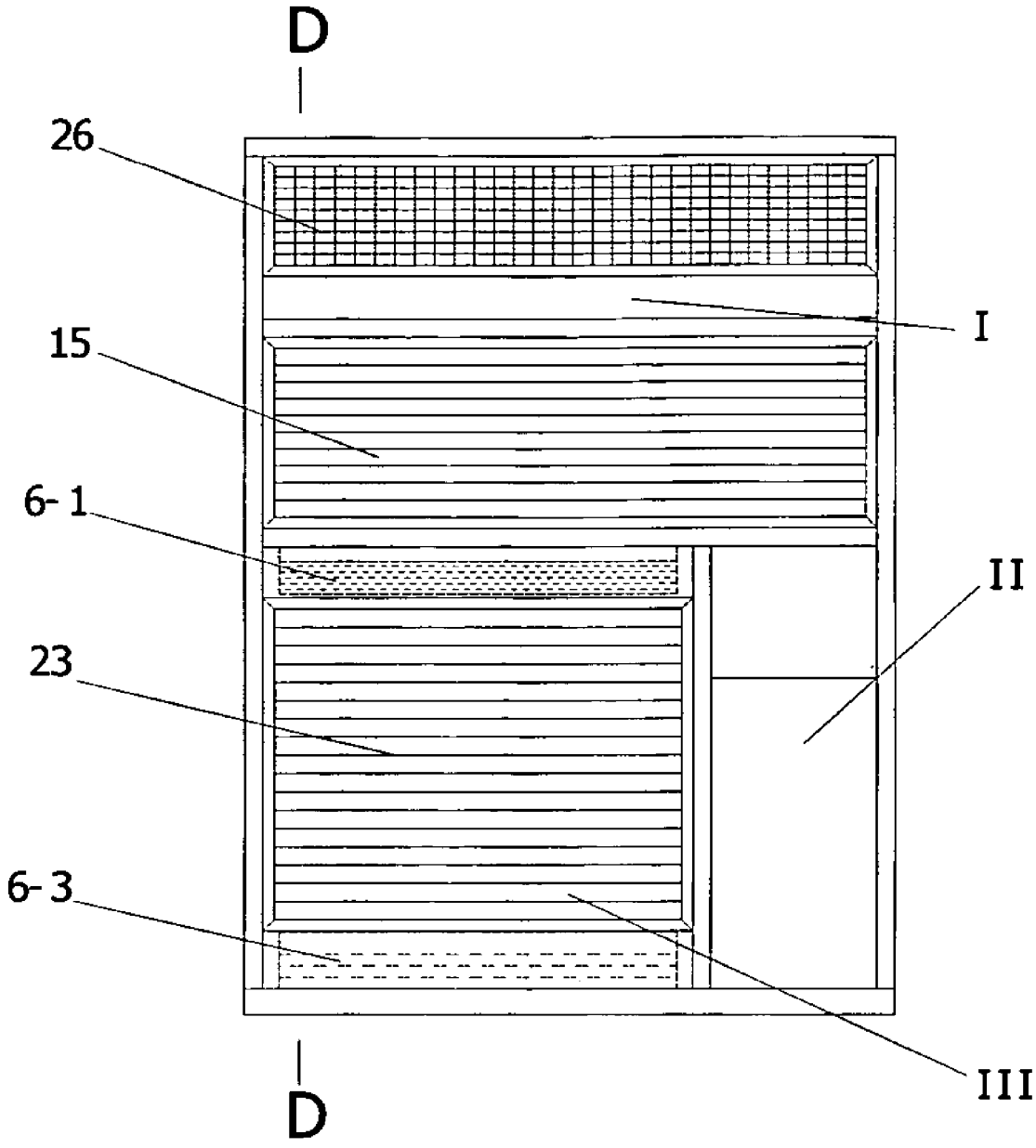
FIG. 5 shows a structural diagram of another embodiment of the air-conditioning system with full heat recovery of the present invention.
Figure 6:
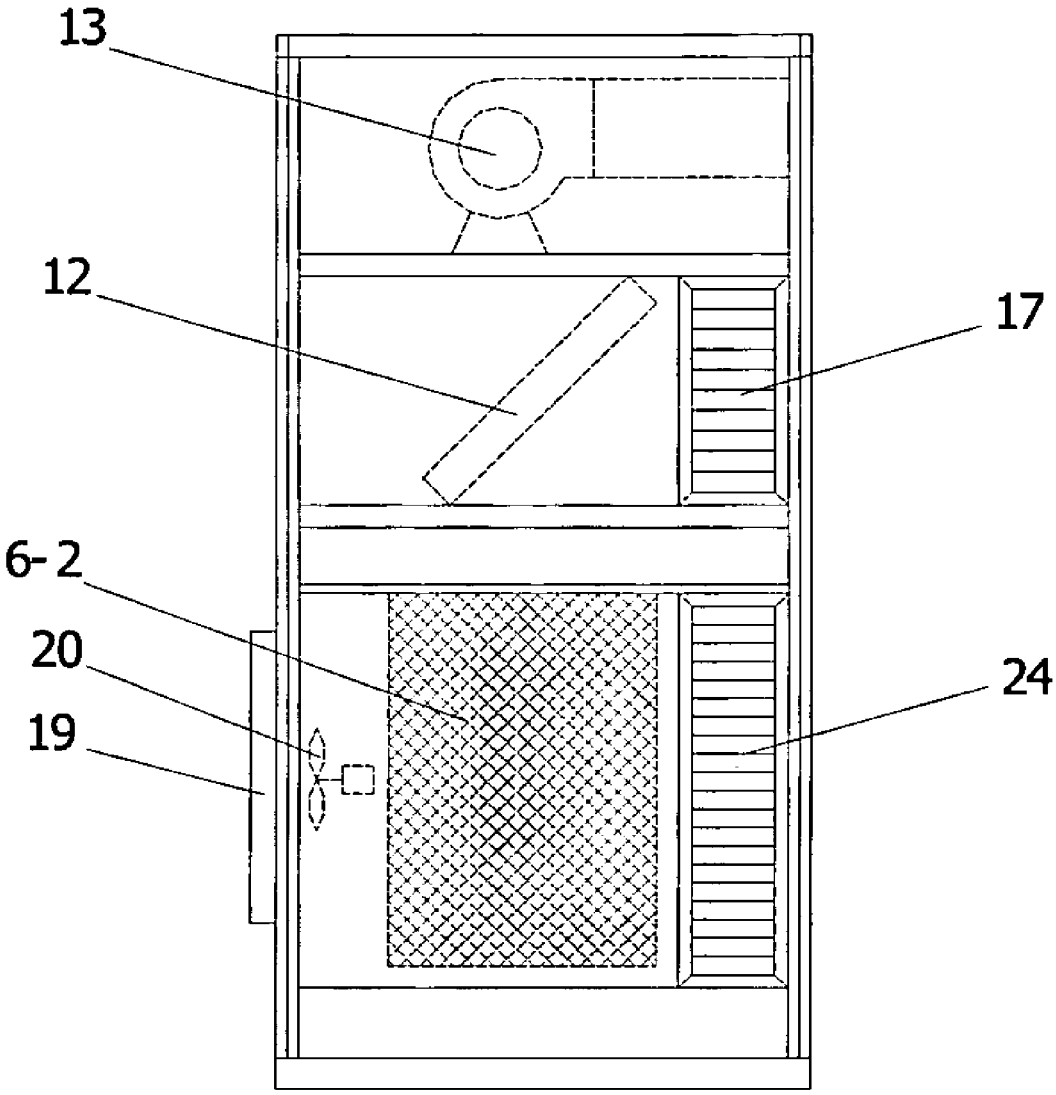
FIG. 6 shows the cross sectional view along line D-D of the air-conditioning system with full heat recovery as in FIG. 5.
Figure 7:
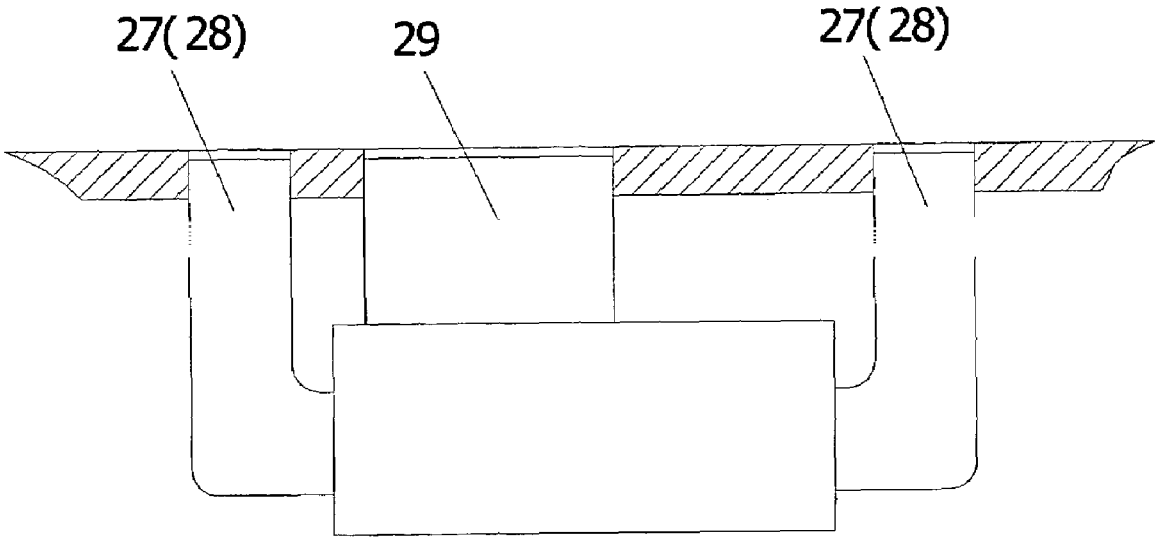
FIG. 7 shows the top view of the air-conditioning system with full heat recovery as in FIG. 5.

FIGS. 5 to 7 show another embodiment of the present invention. In this embodiment, the air-conditioning system with full heat recovery is an integrated type air conditioner comprising three parts I,II,III. As illustrated in FIG. 5, the part I comprises a finned evaporator 12, an air fan 13, a fresh air opening 17, an indoor return air opening 15 and an indoor air vent 26. The indoor return air opening 15 is disposed below the indoor air vent 26 and the finned evaporator 12 is disposed behind the indoor return air opening 15. The fresh air opening 17 is disposed on the two sides of the finned evaporator 12 and connects to the outdoor environment through an air pipe 27. As illustrated in FIG. 7, the fresh air opening 17 and the indoor return air opening 15 are adjustable air openings, where the degree of opening of the air openings is regulated by the airflow regulation valves which are provided in the air openings, thereby controlling air flow. The air fan 13 is disposed above the finned evaporator 12. The part II is installed with refrigerating components such as a compressor 4, a filter-drier 8 and an expansion valve 11 and electrical controlling components for the operation of the unit, the structure thereof is the same as in the first embodiment. The part III is an evaporative condenser 6, the structure thereof is the same as in the first embodiment. An indoor air outlet 23 and an outdoor air inlet 24 is disposed in the space on one side of the heat exchange plate 6-2 and the outdoor air inlet 24 connects to the outdoor environment through an air pipe 28. As illustrated in FIG. 7, the outdoor air inlet 24 is installed with an airflow regulation valve to regulate the mixing ratio of outdoor air and indoor air and the indoor air outlet 23 connects to the indoor environment. An exhaust vent 19 is disposed in the space on the other side of the heat exchange plate 6-2 and the exhaust vent 19 connects to the outdoor environment through an air pipe 29 which penetrates the wall. As illustrated in FIG. 7, a cooling fan 20 is disposed between the exhaust vent 19 and the heat exchange plate 6-2.

The operation of this embodiment is similar to the first embodiment.

Figure 8:
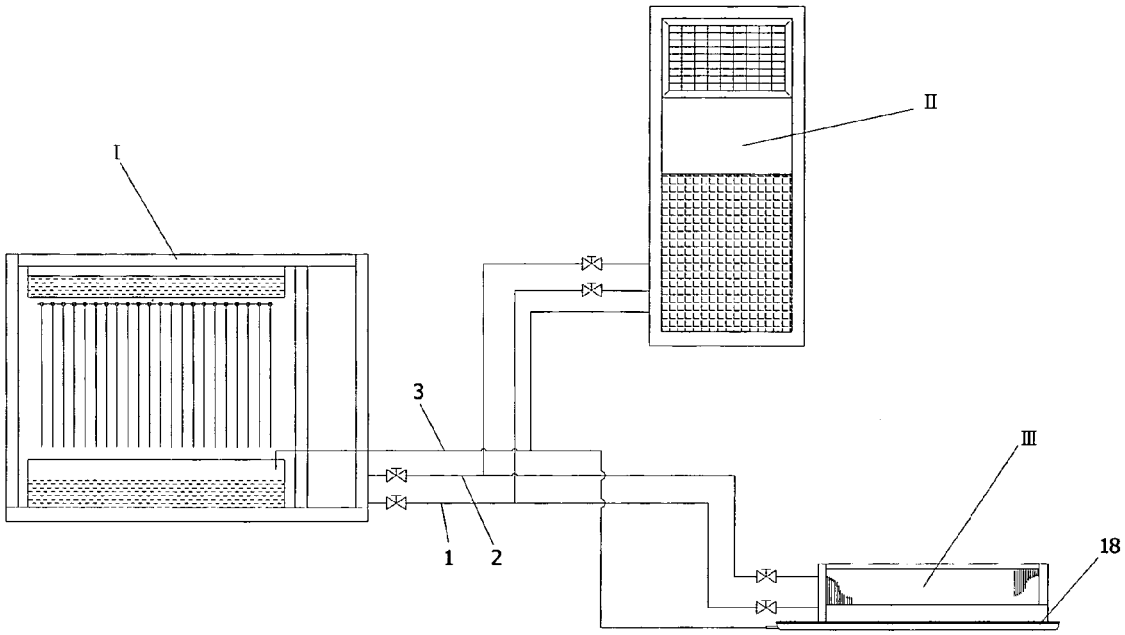
FIG. 8 shows a structural diagram of yet another embodiment of the air-conditioning system with full heat recovery of the present invention.
Figure 9:
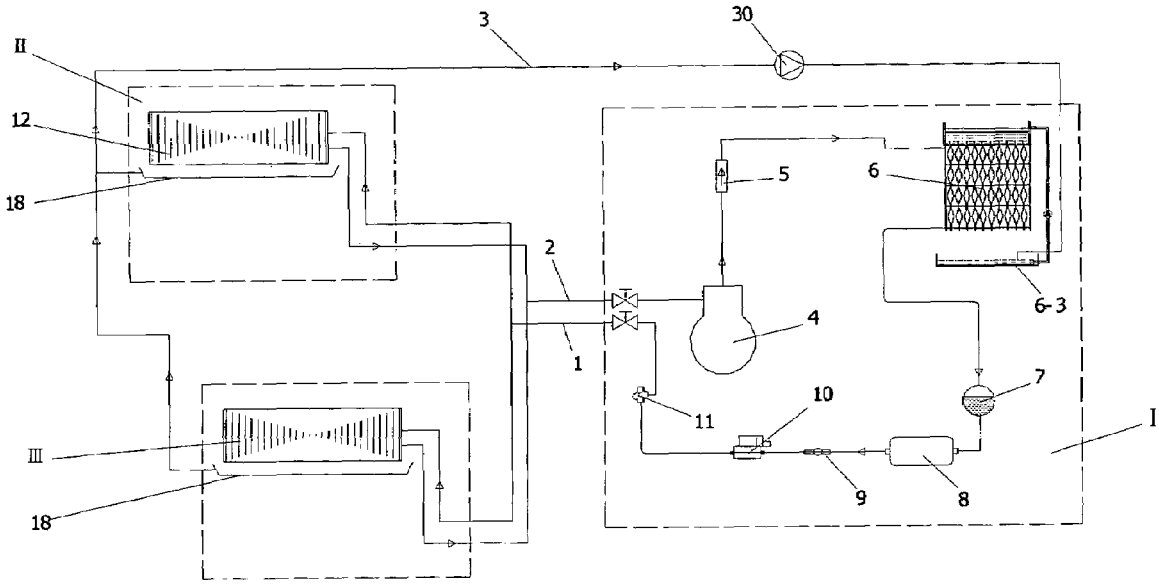
FIG. 9 shows the schematic diagram of the refrigeration process of the air-conditioning system with full heat recovery as in FIG. 8.

FIGS. 8 to 9 show the structure of yet another embodiment of the present invention. In this-embodiment, the air-conditioning system with full heat recovery is a one-plus-two split-type unit. A main unit I connects with two terminals II,III through a liquid supply pipe 1, a return air pipe 2 and a condensate recycling pipe 3. One of the two terminals II,III is an indoor unit 11 and the other is a direct evaporation fan coil unit III. The structure of the main unit I is the same as the main unit (outdoor unit) of the first embodiment and the structure of the indoor unit II is the same as the terminal (indoor unit) of the first embodiment. The direct evaporation fan coil unit III is directly installed indoor. A water receptacle 18-is disposed below the direct evaporation fan coil unit III and the water receptacle 18 connects with a water tank 6-3 through a condensate recycling pipe 3. The condensate recycling pipe 3 can be provided with a water pump 30 if required. It provides power to transfer the condensate of the indoor unit II and the fan coil unit III to the water tank 6-3.

There can be one or more terminals in this embodiment depending on needs. It can all be indoor units or can all be direct evaporation fan coil units. It can also be split-type units of one-plus-multiple combinations of any number of the two types above.

The operation of this embodiment is similar to the first embodiment.

What is claimed is:

1. An air-conditioning system with full heat recovery comprising a condenser, an evaporator, a compressor and an expansion valve, wherein one side of the condenser is disposed in a position corresponding to an indoor air outlet and an outdoor air inlet; the other side of the condenser is provided with an exhaust vent; and a cooling fan is disposed between the exhaust vent and a cooling air opening.

2. The air-conditioning system with full heat recovery as in claim 1, wherein the condenser is installed outdoor, where one side of the condenser is provided with a cooling air opening; the cooling air opening connects with an air pipe and the air pipe connects simultaneously with an indoor air outlet and an outdoor air inlet through subsidiary pipes; the indoor air outlet is disposed on the wall separating the indoor and outdoor environments and the outdoor air inlet connects to the outdoor atmosphere directly.

3. The air-conditioning system with full heat recovery as in claim 1, wherein the condenser is installed indoor, where the space on one side of the condenser is provided with an indoor air outlet and an outdoor air inlet; the indoor air outlet connects to the indoor environment and the outdoor air inlet connects to the outdoor environment through an air pipe; the space on the other side of the condenser is provided with an exhaust vent and the exhaust vent connects to the outdoor environment directly or through an air pipe.

4. The air-conditioning system with full heat recovery as in any of claims 1 to 3, wherein the outdoor air inlet is installed with an airflow regulation valve.

5. The air-conditioning system with full heat recovery as in claim 1, wherein the condenser is an evaporative condenser comprising a water sprayer, a heat exchange plate or heat exchange tube, a water tank and a recycling water pump; the water sprayer is disposed above the heat exchange plate or heat exchange tube; the water tank is disposed below the heat exchange plate or heat exchange tube; the recycling water pump connects with the water sprayer and the water tank.

6. The air-conditioning system with full heat recovery as in claim 5, wherein the heat exchange plate comprises a plate body and the plate body is provided with channels.

7. The air-conditioning system with full heat recovery as in claim 5, wherein it comprises a condensate recycle system and the condensate recycle system connects with a water sprayer or a water tank of the evaporative condenser.

8. The air-conditioning system with full heat recovery as in claim 7, wherein the condensate recycle system comprises a water receptacle and a condensate pipe; the water receptacle is disposed below an evaporator; one end of the condensate pipe connects with the water receptacle and the other end thereof connects with the water sprayer or the water tank.

9. The air-conditioning system with full heat recovery as in claim 8, wherein the condensate pipe connects with a water pump.

10. The air-conditioning system with full heat recovery as in claim 1, wherein the evaporator is a finned evaporator.

* * * * *